United States Patent [19]

Shimoda

[11] Patent Number: 4,465,000

[45] Date of Patent: Aug. 14, 1984

[54] METHOD OF INCREASING THE EFFICIENCY OF CYCLONE-FIRED BOILERS USING HIGH SODIUM LIGNITE FUEL

[75] Inventor: Elwyn Shimoda, Ponca City, Okla.

[73] Assignee: Conoco Inc., Ponca City, Okla.

[21] Appl. No.: 567,600

[22] Filed: Jan. 3, 1984

Related U.S. Application Data

[63] Continuation of Ser. No. 346,795, Feb. 8, 1982, abandoned.

[51] Int. Cl.[3] ..... F23D 1/00; F23G 7/00

[52] U.S. Cl. ..... 110/343; 110/245; 110/263; 44/4

[58] Field of Search ..... 110/343, 344, 347, 348, 110/245, 263; 44/1 R, 4; 431/3, 4; 122/390

[56] References Cited

U.S. PATENT DOCUMENTS

| | | | |
|---|---|---|---|
| 1,167,472 | 1/1916 | Babba | 44/1 R |
| 2,905,116 | 9/1959 | Sifrin | 110/344 |
| 2,935,956 | 5/1960 | Welch | 110/343 |
| 3,234,580 | 2/1966 | Keck | 15/302 |
| 4,159,683 | 7/1979 | Hughes et al. | 110/343 |
| 4,237,103 | 12/1980 | Prible | 110/343 |
| 4,253,408 | 3/1981 | Kramer | 110/343 |
| 4,259,911 | 4/1981 | Jones | 110/245 |
| 4,312,280 | 1/1982 | Shearer et al. | 110/263 |
| 4,325,327 | 4/1982 | Kantesania et al. | 110/245 |

OTHER PUBLICATIONS

B. K. Baker and W. H. Gardiner, Modification of Ash Behavior in Lignite Fired Boilers, USDOE Report No. GFERC/IC-77-1.

F. I. Honea, D. K. Rindt, R. Middleton, and D. Rothe, The Use of Additives to Reduce Ash Fouling Problems in Lignite-Fired Boilers ASME Paper 80/JPGC/FU-3, Sep. 28-Oct. 2, 1980.

E. M. Levin, C. R. Robbins, H. F. McMurdie, Phase Diagrams for Ceramists, The American Ceramic Society, Inc., 1964, FIG. 1113.

Full-Scale Desulfurization of Stack Gas by Dry Limestone Injection, EPA Report No. 650/2-73-019-a, vol. 1, Aug. 1973, p. 45.

R. C. Attig and P. Sedor, Additive Injection for Sulfur Dioxide Control-A Pilot Plant Study, National Air Pollution Control Administration, Research Center Report 5460, pp. 4-4.

*Primary Examiner*—Henry C. Yuen

*Attorney, Agent, or Firm*—Richard W. Collins

[57] ABSTRACT

A method of increasing the efficiency of a cyclone-fired boiler which uses high sodium lignite as fuel. The fuel produces ash deposits on heat transfer surfaces within the boilers, and in accordance with the method, powdered limestone is periodically injected into the firebox of the boiler in a quantity and for a time period such that the limestone is heated to a temperature in the range of from about 2200° F. to about 2700° F. and reacts with ash deposits in the boiler to form layers thereon. The layers so formed have a higher ash fusion temperature than the unreacted deposits and cause the resulting composite deposit to be more friable whereby the deposit can be removed using conventional soot blower apparatus.

3 Claims, 5 Drawing Figures

DOSAGE RATE AND CYCLE PERIOD

DOSAGE RATE AND CYCLE PERIOD

METHOD OF INCREASING THE EFFICIENCY OF CYCLONE-FIRED BOILERS USING HIGH SODIUM LIGNITE FUEL

This is a continuation of application Ser. No. 346,795 filed Feb. 8, 1982, abandoned.

BACKGROUND OF THE INVENTION

1. Field of the Invention

The present invention relates to methods of increasing the efficiency of a cyclone-fired boiler using high sodium lignite fuel, and more particularly, but not by way of limitation, to methods of modifying ash deposits produced from the combustion of high sodium lignite fuel within cyclone-fired boilers whereby such deposits can be removed using conventional techniques.

2. Description of the Prior Art

Modern utility boilers such as those utilized in power plants commonly utilize solid fuels which bring about the formation of ash deposits on heat transfer surfaces within the boilers. The problem is particularly severe in cyclone-fired boilers which utilize high sodium lignite fuel. The combustion of the fuel produces ash containing, among other things, sodium sulfate and calcium sulfate which deposits on convective heat transfer surfaces within the boiler. The deposits reduce the heat transfer from the products of combustion to the fluid being heated making the operation of the boiler less efficient, and because the deposits are not friable, periodic shutdowns of the boiler for the physical removal of the deposits are required. The term "high sodium lignite fuel" is used herein to mean solid carbonaceous fuel containing a high concentration of sodium compounds in lignite, i.e., a fuel which when combusted produces ash which when analyzed in the oxidized state contains sodium oxide ($Na_2O$) in an amount greater than about 4.5% by weight.

Apparatus known as soot blowers have been used heretofore for removing ash deposits from heat exchange surfaces in power boilers without shutdown of the boilers being required. However, as stated above, in cyclone-fired boilers using high sodium lignite fuel the deposits produced on the heat exchange surfaces are difficult to remove with such soot blower apparatus.

Various methods have heretofore been proposed for reducing the quantity of deposits formed or for altering the structure of the deposits to enable effective removal of the deposits using conventional soot blower apparatus. For example, the slug dosing of limestone into pulverized coal-fired burners has heretofore been utilized in attempts to modify lignite ash deposits and make them more readily removable. See Baker, B. K. and W. H. Gardiner, "Modification of Ash Behavior in Lignite Fired Boilers," presented at the Lignite Symposium held at Grand Forks, North Dakota on May 18–19, 1977, USDOE Report No. GFERC/IC-77-I. Also, slug dosing of limestone into cyclone-fired boilers has been attempted to modify the lignite ash deposits produced. However, such attempts have been unsuccessful in improving boiler efficiency and reducing down time for cyclone-fired furnaces. See Honea, F. I., Rindt, D. K., R. Middleton and D. Rothe, "The Use of Additives to Reduce Ash Fouling Problems in Lignite-Fired Boilers," presented at the Joint Power Generation Conference ASME Paper 80-JPGC/FU-3, Sept. 28–Oct. 2, 1980, Phoenix, Ariz.

U.S. Pat. No. 1,167,472 issued to Babba on Jan. 11, 1967 discloses the addition of limestone to powdered coal burned in a furnace for the purpose of modifying the properties of the ash formed in the furnace.

U.S. Pat. No. 2,905,116 issued to Sifrin et al. on Sept. 22, 1959 discloses the addition of a low quality fuel such as fly ash and a high quality fuel to a cyclone-fired furnace.

U.S. Pat. No. 3,234,580 issued to Keck on Feb. 15, 1966 discloses the periodic injection of lime to protect boiler surfaces.

By the present invention an improved method of increasing the efficiency of a cyclone-fired boiler using high sodium lignite fuel is provided whereby the ash deposits produced on heat transfer surfaces within the boiler are modified to facilitate the removal of the deposits utilizing conventional soot blower apparatus.

SUMMARY OF THE INVENTION

A method of increasing the efficiency of a cyclone-fired boiler using high sodium lignite fuel which produces ash deposits on heat transfer surfaces within the boiler comprising the steps of periodically injecting powdered limestone into the firebox of the boiler in a quantity and for a period of time such that the limestone is heated to a temperature in the range of from about 2200° F. to about 2700° F. and reacts with ash deposits in said boiler to form layers thereon and periodically removing the deposits and layers formed thereon from the heat transfer surfaces.

It is, therefore, a general object of the present invention to provide a method of increasing the efficiency of cyclone-fired boilers using high sodium lignite fuel.

A further object of the present invention is the provision of a method of modifying the ash deposits produced in cyclone-fired boilers using high sodium lignite fuel whereby such deposits are removable using conventional soot blower apparatus.

Other and further objects, features and advantages of the invention will be readily apparent to those skilled in the art upon a reading of the description of preferred embodiments which follows when taken in conjunction with the accompanying drawings.

DESCRIPTION OF PREFERRED EMBODIMENTS

In cyclone-fired utility boilers wherein crushed solid fuel is intimately mixed with air and combusted, the use of high sodium lignite fuel produces extensive ash deposits which adhere to convective heat transfer surfaces within the boilers and which are often difficult or impossible to remove with conventional soot blower apparatus. By the present invention such ash deposits are modified whereby the deposits are more friable and can be knocked off using such soot blower apparatus.

The increase in the friability of the deposits is accomplished by periodically injecting powdered limestone into the firebox of a cyclone-fired boiler above the flames of burning high sodium lignite fuel therein in a quantity and for a period of time such that the limestone is heated to a temperature in the range of from about 2200° F. to about 2700° F. and reacts with ash deposits in the boiler to form layers on the deposits, the layers having a higher ash fusion temperature and friability than the unreacted deposits thereby making the resulting composite deposit more friable and removable with soot blowers.

Figure 1:
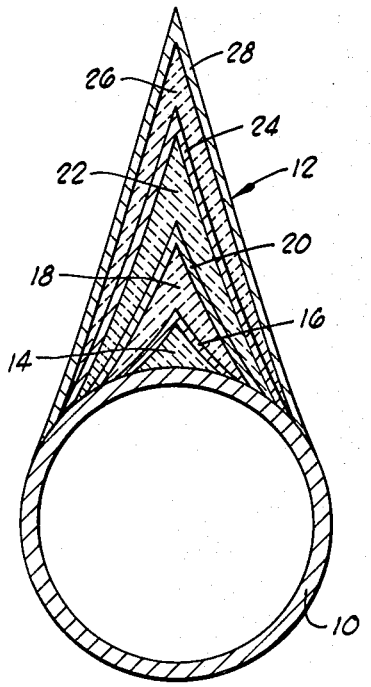
FIG. 1 is a cross-sectional view of a typical boiler heat exchange tube having a deposit formed in accordance with the method of the present invention adhered thereto.

Referring to the drawings, and particularly to FIG. 1, a typical heat exchange tube 10 having a composite ash deposit 12 formed thereon in accordance with the method of the present invention is illustrated. The composite deposit 12 is comprised of an initial ash deposit 14 formed from the combustion of high sodium lignite fuel adhered to the heat transfer tube 10. Adhered to the ash deposit 14 is a layer 16 of a more friable ash deposit resulting from the injection of powdered limestone into the boiler and the reaction of the limestone with the ash on the surface of the ash deposit 14. Adhered to the layer 16 and the tube 10 is another ash deposit 18 formed as a result of burning high sodium lignite fuel and adhered to the deposit 18 is a more friable ash deposit layer 20 formed from the reaction of the ash deposit 18 with powdered limestone injected into the boiler. An additional ash deposit 22 having a layer 24 formed by the reaction of powdered limestone therewith and another ash deposit 26 having a layer 28 formed thereon by the reaction of powdered limestone therewith are adhered to the layer 20 and to the tube 10. As will be understood, additional or fewer ash deposits and more friable layers thereof can be formed on the heat transfer tube 20 depending upon the frequency of limestone injection and how often the composite deposit 12 is removed from the tube 10.

As described above, the more friable layers 16, 20, 24 and 28 are formed on and in the composite deposit 12 by periodically injecting powdered limestone into the firebox of the boiler above the flames of burning sodium lignite fuel therein in a quantity and for a time period such that the limestone is heated to a temperature in the range of from about 2200° F. to about 2700° F. and reacts with the ash deposits 14, 18, 22 and 26 after they are formed.

Figure 2:
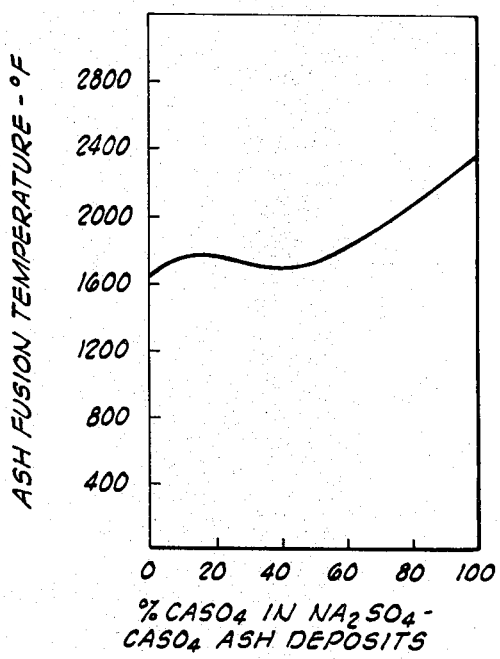
FIG. 2 is a phase diagram of a mixture of calcium sulfate and sodium sulfate in equilibrium at different concentrations and ash fusion temperatures.

Referring to FIG. 2, the relationship of ash fusion temperature to the concentration of calcium sulfate in ash deposits formed as a result of the burning of high sodium lignite fuel is shown in diagrammatical form. The ash deposits include sodium sulfate and calcium sulfate and by changing the concentration of the mixture, a change in the ash fusion temperature is achieved. See Levin, E. M., Robbins, C. R., and McMurdie, H. F., "Phase Diagrams for Ceramists," The American Ceramic Society, Inc., 1964, FIG. 1113. As the concentration of calcium sulfate in the deposits increases, the ash fusion temperature also increases. Further, the higher the ash fusion temperature of a deposit, the more friable is the deposit.

The reaction of the ash deposits containing sodium sulfate and calcium sulfate with heated powdered limestone, i.e., calcined limestone (CaO), forms layers on the ash deposits having increased concentration of calcium sulfate, and consequently, increased ash fusion temperature and friability. The existence of the more friable layers 16, 24 and 28 in the composite deposit 12 cause the deposit 12 to have a friability such that it can be removed using soot blower apparatus and thereby eliminating the heretofore required boiler shutdowns and physical removal of deposits produced by burning high sodium lignite fuel using jackhammers, chisels, etc.

In order for the method of this invention to bring about the desired result, i.e., a composite deposit of the required friability, the injection of the powdered limestone must be accomplished in a manner whereby the limestone is heated (and thereby calcined) and reacts with the ash deposits very rapidly. This requires that the limestone in fine particle form be injected into the firebox of the boiler at a location therein where the combustion gas temperature is in the temperature range of from about 2200° F. to about 2700° F., i.e., the region of rapid chemical reaction shown in FIG. 3.

Figure 3:
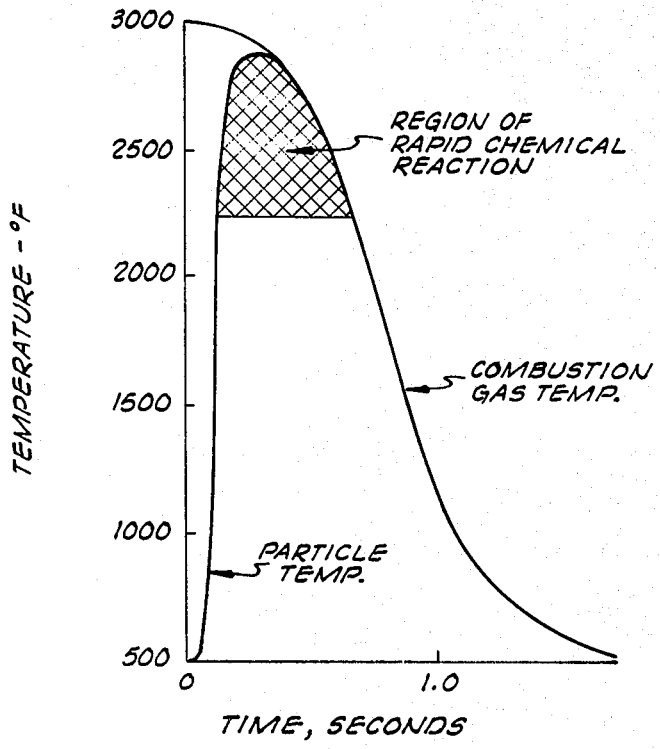
FIG. 3 is a diagram which represents the time-temperature relationship of an injected limestone particle as it travels in a typical utility furnace.

FIG. 3 represents the time/temperature relationship of an injected limestone particle as it travels in a typical utility furnace. See "Full-Scale Desulfurization of Stack Gas by Dry Limestone Injection," EPA Report No. 650/2-73-019-a, Volume 1, August 1973, page 45. The limestone particle rapidly heats up to the peak temperature (a time period of a few milliseconds) when it is in equilibrium with the surrounding combustion gas temperature. As the particle continues to travel through the furnace, its temperature then drops due to the removal of heat from the combustion gases and the drop in temperature thereof. The heating of the limestone particle causes it to be calcined to a calcium oxide particle in accordance with the reaction:

$$\underset{(CaCO_3)}{\text{limestone}} \xrightarrow{\text{heat}} \underset{(CaO)}{\text{lime}} + \underset{(CO_2)}{\text{carbon dioxide}}$$

The calcium oxide particle is quite reactive at temperatures in the range of from about 2200° F. to about 2700° F. (the region of rapid chemical reaction shown as the cross-hatched area of FIG. 3) and consequently readily reacts with ash deposits to form a more friable layer thereon. See Attig, R. C. and Sedor, P., "Additive Injection for Sulfur Dioxide Control—A Pilot Plant Study," National Air Pollution Control Administration, Research Center Report 5460, page 4—4.

The powdered limestone must be injected at a point far enough upstream of the heat transfer surfaces of the furnace so that the residence time of the injected limestone is about two seconds. If the powdered limestone remains in the temperature range of from about 2200° F. to about 2700° F. for a time period of longer than about two seconds, the limestone will become unreactive, and if the residence time of the limestone is too short, it will not reach the required temperature range. Finally, the powdered limestone must be dispersed in a manner such that after being heated it comes into contact with as much surface of the existing ash deposit in the boiler as possible.

Figure 4:
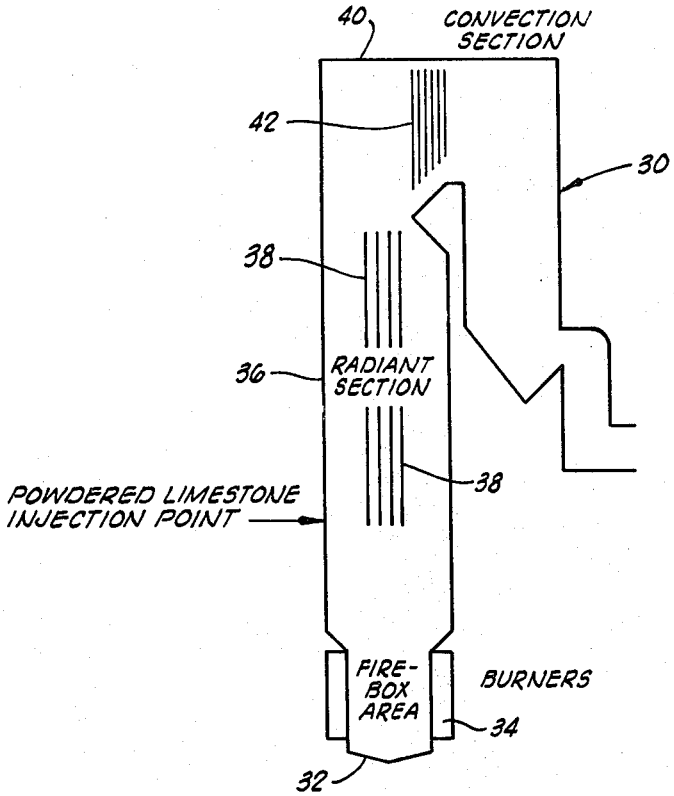
FIG. 4 is a schematic illustration of a typical cyclone-fired furnace.

Referring to FIG. 4, a typical cyclone-fired furnace 30 is illustrated schematically. The furnace 30 includes a firebox 32 having burners 34 operably connected thereto. A radiant section 36 of the furnace containing vertical heat transfer tubes 38 is an integral part of the wall above the firebox 32, and a convection section 40 containing heat transfer tubes 42 is located at the top of the furnace 30. The point of injection of powdered limestone into the furnace 30 varies depending upon the temperature of the combustion gases within the furnace. Generally, the firebox temperature is about 3000° F. and the design temperature of the convection section is less than about 1950° F. The temperature of the combustion gases at the point of injection of the powdered limestone should be no higher than 2700° F. (FIG. 3), and on this basis, the injection point is located in the lower third of the radiant section 36 of the furnace 30 as shown in FIG. 4.

Figure 5:
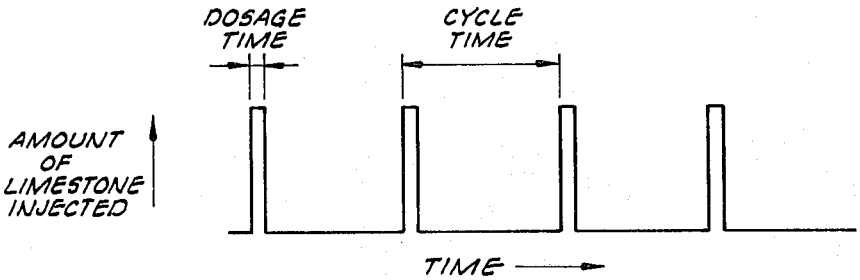
FIG. 5 is a graph illustrating the dosage rate and cycle period of powdered limestone injected into a cyclone-fired furnace in accordance with this invention.

A graph of a typical dosage rate and cycle period for the injection of powdered limestone into a cyclone-fired furnace is illustrated in FIG. 5. The amount of limestone injected, dosage time and cycle time will vary from furnace to furnace depending on the size, design, etc., but generally the total quantity of limestone is calculated to approximate the stoichiometric quantity required to shift the concentration of the $CaSO_4$—$Na_2SO_4$ ash deposits in the boiler so that the ash fusion temperature increases substantially to effect a change in the deposit.

Thus, in accordance with the method of the present invention, powdered limestone is periodically injected into the firebox of a cyclone-fixed boiler, i.e., the boiler is slug dosed with limestone. The injection is at a location whereby the limestone has a residence time in the firebox in contact with combustion gases having a temperature in the range of from about 2200° F. to about 2700° F. of about two seconds prior to reacting with ash deposits on heat exchange surfaces in the boiler. The reaction forms composite deposits having a friability such that the deposits can be removed using conventional soot blower apparatus.

In order to facilitate a clear understanding of the methods of the present invention, the following examples are presented.

EXAMPLE 1

A 440-MW cyclone-fired utility power plant burns about 8,000 tons of lignite fuel per day. A typical analysis of the lignite fuel is presented in Table I below. Fly ash from a cyclone-fired boiler usually accounts for about 30% of the total ash generated. There is normally a sodium enrichment in the fly ash due to the high-temperature firing rate of a cyclone-fired boiler. A typical ratio of calcium to sodium in fly ash is shown on a weight percent basis in Table II below.

Powdered limestone is injected into the cyclone-fired boiler of the power plant on a slug dose basis as shown in FIG. 5. The dosage amount (amount of limestone injected) is 300 pounds of limestone, the dosage time is 10 seconds and the cycle time is 30 minutes.

The following sample calculations illustrate the shift in composition due to the periodic injections of limestone into the cyclone-fired boiler.

1. Lignite: 8,000 tons per day=1,852 pounds per 10-second dosage period
2. Fly ash generated (dry basis):

$$\text{Lignite} \times \text{moisture-free basis} \times \text{total ash generated} \times \frac{\text{fly ash}}{\text{total ash}} = \text{fly ash generated}$$

$$(1{,}852 \text{ pounds})\ (1.000-0.435)\ (0.167)\ (0.30) = 52.4 \text{ pounds fly ash}$$

3. Pound moles CaO (weight percent from Table II, Case 1):

$$(52.4 \text{ pounds})(0.17)/(56.08 \text{ pounds per pound mole}) = 0.16 \text{ pound moles CaO}$$

4. Pound moles $Na_2O$ (weight percent from Table II, Case 1):

$$(52.4 \text{ pounds})(0.071)/52 \text{ pounds per pound mole}) = 0.07 \text{ pound moles } Na_2O$$

5. Pound moles sulfur on moisture-free basis:

$$(1{,}852 \text{ pounds})(1.000-0.435)(0.012)/(32.07 \text{ pounds per pound mole} = 0.392\text{-pound moles sulfur}$$

6. Pound moles $SO_2$: From the equation $S+O_2 \rightarrow SO_2$, there is an equal number of moles of $SO_2$ for every mole of S; therefore, 0.392 pound moles sulfur dioxide are generated.
7. Assuming that all of the CaO and $Na_2O$ reacts with the $SO_2$ in a stoichiometric amount, then from Steps 3, 4, and 6, we have:

$$0.16CaO+0.16SO_2+0.08O_2 \rightarrow 0.16CaSO_4$$

$$0.07Na_2O+0.07SO_2+0.035O_2 \rightarrow 0.07Na_2SO_4$$

or $$0.16CaO+0.07Na_2O+0.23SO_2+0.115O_2 \rightarrow (0.16CaSO_4+0.07Na_2SO_4).$$

The combination of $Na_2SO_4$ and $CaSO_4$ forms a mixture that has a melting point depending on the composition as shown in FIG. 2. For this mixture, there is 69 mole percent $CaSO_4$ and 31 mole percent of $Na_2SO_4$. From FIG. 2, the ash fusion temperature for this mixture is 1945° F.

8. Available $SO_2$:
   From 6: 0.392 pound moles $SO_2$
   From 7: −0.23 pound moles $SO_2$
   Remaining: 0.162 pound moles $SO_2$ available for reaction
9. Available CaO from injected limestone:

$$CaCO_3 \xrightarrow{heat} CaO + CO_2$$

$$(300 \text{ pounds limestone})/(100.1 \text{ pounds per pound moles}) = 3 \text{ pound moles limestone}$$

$$3 \text{ pound moles limestone} = 3 \text{ pound moles CaO}$$

With 3 pound moles of CaO available in a 10-second dosing period, there is sufficient excess of CaO (3 pound moles) to react with the balance of the $SO_2$ (0.162 pound moles) from Step 8 to form additional $CaSO_4$, as in the equation:

$$\text{Excess CaO}+0.162SO_2+0.081O_2 \rightarrow 0.162CaSO_4+\text{excess CaO}$$

10. Shift in mixture composition after dosing with increase in ash fusion temperature:

From 7: $0.16CaSO_4+0.07Na_2SO_4$
From 9: $+0.162CaSO_4$+excess CaO
Total: $0.322CaSO_4+0.07Na_2SO_4$ which contains 82 mole percent $CaSO_4$ and 18 percent $Na_2SO_4$.

From FIG. 2, the ash fusion temperature for this mixture is 2130° F. for a 185° F. raise in the mixture temperature.

Table III below summarizes the calculations for shifts in mixture compositions for Cases 1, 2, and 3 set forth in Table II. The increase in ash fusion temperature is in the 170° F. to 185° F. range, which causes the dosed deposit to be more friable and subject to easier removal using soot blowers.

TABLE I*

| LIGNITE COAL ANALYSES | |
|---|---|
| Total moisture (percent) | 43.5 |
| Proximate analysis (dry) | |
| Volatile matter (percent) | 40.1 |
| Fixed carbon (percent) | 43.2 |
| Ash (percent) | 16.7 |
| BTU per pound (dry) | 9,880 |
| Sulfur (dry) (percent) | 1.2 |

TABLE II*

| FLY ASH ANALYSES FROM A CYCLONE FIRED BOILER (WEIGHT PERCENT) | | | |
|---|---|---|---|
| | Case 1 | Case 2 | Case 3 |
| $SiO_2$ | 38 | 27 | 29 |
| $Al_2O_3$ | 11 | 11 | 12 |
| $Fe_2O_3$ | 4.6 | 3 | 3 |
| $TiO_2$ | 0.8 | 0.7 | 0.8 |
| CaO | 17 | 18 | 17 |
| MgO | 7.5 | 8 | 8 |
| $Na_2O$ | 7.1 | 10.2 | 11.3 |
| $K_2O$ | 0.5 | 0.5 | 0.4 |

*From Haller, K. H. and G. F. Moore, "Burning North Dakota Lignite in a Modern Utility Boiler, Big Stone Test," ASME paper 79-WA/FU-5, 1980.

TABLE III

| SAMPLE CALCULATIONS BASED ON 10-SECOND DOSAGE | | | |
|---|---|---|---|
| | Case 1 | Case 2 | Case 3 |
| Amount of $SO_2$ being generated (pound moles) | 0.392 | 0.392 | 0.392 |
| CaO in fly ash (pound moles) | 0.16 | 0.17 | 0.16 |
| $Na_2O$ in fly ash (pound moles) | 0.07 | 0.10 | 0.114 |
| Mole percent CaO:mole percent $Na_2O$ | 69:31 | 62:38 | 58:42 |
| Ash fusion temperature, °F. | 1,945 | 1,845 | 1,785 |
| Modified deposit composition with | | | |
| Added CaO (pound moles) | 0.322 | 0.292 | 0.278 |
| Same amount of $Na_2$ in fly ash (pound moles) | 0.07 | 0.10 | 0.114 |
| Shift in concentration: | | | |
| Mole percent CaO:mole percent $Na_2O$ | 82:18 | 74:26 | 71:29 |
| Ash fusion temperature, °F. | 2,130 | 2,015 | 1,970 |
| Increase in ash fusion temperature, °F. | 185 | 170 | 185 |

EXAMPLE 2

An ash-fouling deposit from the convective portion of a cyclone-fired utility power plant was obtained, and the analysis is shown as the base case in Table IV below. A separate 20-gram portion of the ash-fouling deposit was thoroughly mixed with 5 grams of limestone and analyzed for elemental ash analyses and ash fusion temperature. This is shown as the test case in Table IV. An increase in ash fusion temperature of 140° F. was obtained by the increase of calcium oxide from 18.36 to 35.46 percent.

TABLE IV

| COMPARISON OF ASH FUSION TEMPERATURE WITH LIMESTONE ADDED TO ASH-FOULING DEPOSIT | | |
|---|---|---|
| | Elemental Ash Analyses (Weight Percent) | |
| | Base Case[1] | Test Case (Limestone Added)[2] |
| $SiO_2$ | 29.46 | 23.82 |
| $Al_2O_3$ | 9.74 | 8.48 |
| $Fe_2O_3$ | 6.40 | 5.90 |
| $TiO_2$ | 0.82 | 0.67 |
| CaO | 18.36 | 35.46 |
| MgO | 4.63 | 3.94 |
| $Na_2O$ | 8.90 | 8.06 |
| $K_2O$ | 1.11 | 0.91 |
| Ash fusion temperature, °F. (softening point) | 2,200 | 2,340 |
| Increase in ash fusion temperature, °F. | | 140 |

[1]Ash-fouling deposit from a cyclone-fired unit was analyzed for elemental ash analyses and ash fusion temperatures.

[2]The 20 grams of the same base-case deposit were thoroughly mixed with 5.01 grams of limestone and then analyzed on the same basis as the base case.

While numerous changes and arrangements of steps of the methods can be made by those skilled in the art, such changes are encompassed within the spirit of this invention as defined by the appended claims.

The embodiments of the invention in which an exclusive property or privilege is claimed are defined as follows:

1. A method of increasing the efficiency of a cyclone-fired boiler using high sodium lignite fuel which produces ash deposits on heat transfer surfaces within the boiler comprising:

(a) cyclically injecting, separately from the supply of said fuel to said boiler, time-spaced doses of powdered limestone into the firebox of said boiler at a location such that said limestone is heated to a temperature in the range of from about 2200° F. to about 2700° F. and maintained in said temperature range for a time period less than the time at which said limestone becomes unreactive, (b) contacting ash deposits on said heat transfer surfaces, which have formed from operation between said doses, with said limestone which is in said temperature range, whereby said limestone and ash deposits react to form a layer which is more friable than said ash deposits and which has an ash fusion temperature higher than that of said ash deposits; and (c) periodically removing said deposits from said heat transfer surfaces; wherein said doses are injected at a location such that the powdered limestone is maintained in said temperature range for about two seconds prior to contacting ash deposits on said heat transfer surfaces and each dose of powdered limestone is injected for a period of ten seconds, and the time interval between doses is thirty minutes.

2. A method of increasing the efficiency of a cyclone-fired boiler using high sodium lignite fuel which produces ash deposits containing sodium sulfate and calcium sulfate on convective heat transfer surfaces within said boiler comprising the steps of:

(a) cyclically injecting, separately from the supply of said fuel to said boiler, time-spaced doses of powdered calcium carbonate into the firebox of said boiler above the flames of burning sodium lignite fuel therein in a quantity and at a location such that said calcium carbonate is heated to a temperature in the range of from about 2200° F. to about 2700° F. and maintained in said temperature range for a time period less than the time at which calcium carbonate becomes unreactive;

(b) contacting ash deposits on said heat transfer surfaces, which have formed from operation between said doses, with said calcium carbonate which is in said temperature range, whereby said calcium carbonate and ash deposits react to form a layer which is more friable than said ash deposits and which has an ash fusion temperature higher than that of said ash deposits; and (c) periodically removing said deposits from said heat transfer surfaces; wherein said doses are injected at a location such that the powdered calcium carbonate is maintained in said temperature range for about two seconds prior to contacting ash deposits on said heat transfer surfaces and each dose of calcium carbonate is injected for a period of ten seconds, and the time interval between doses is thirty minutes.

3. The method of claim 2 wherein said calcium carbonate is limestone.

* * * * *